US010815911B2

(12) United States Patent
Tanaka et al.

(10) Patent No.: US 10,815,911 B2
(45) Date of Patent: Oct. 27, 2020

(54) ENGINE STOPPING DEVICE

(71) Applicant: KUBOTA Corporation, Osaka-shi, Osaka (JP)

(72) Inventors: Akira Tanaka, Sakai (JP); Hiroki Oso, Sakai (JP); Yoshinori Tanaka, Sakai (JP); Hideyuki Koyama, Sakai (JP); Takahiro Yamazaki, Sakai (JP); Nobuyoshi Okada, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 25 days.

(21) Appl. No.: 16/205,855

(22) Filed: Nov. 30, 2018

(65) Prior Publication Data

US 2019/0186386 A1 Jun. 20, 2019

(30) Foreign Application Priority Data

Dec. 14, 2017 (JP) ..... 2017-240015

(51) Int. Cl.

| | |
|---|---|
| ***F02M 59/44*** | (2006.01) |
| ***F02D 17/04*** | (2006.01) |
| ***F02D 1/02*** | (2006.01) |
| *F02D 1/08* | (2006.01) |

(52) U.S. Cl.

CPC ..... *F02D 17/04* (2013.01); *F02D 1/02* (2013.01); *F02M 59/447* (2013.01); *F02D 2001/085* (2013.01)

(58) Field of Classification Search

CPC ..... F02D 17/04; F02D 1/02; F02D 2001/085; F02M 59/447

See application file for complete search history.

(56) References Cited

U.S. PATENT DOCUMENTS

| | | | | |
|---|---|---|---|---|
| 3,338,224 A * | 8/1967 | Isley | F02D 1/10 | 123/374 |
| 3,918,318 A * | 11/1975 | Phillips | F02D 1/02 | 74/490.11 |
| 4,208,998 A * | 6/1980 | Hofmann | F02D 1/12 | 123/179.17 |

(Continued)

FOREIGN PATENT DOCUMENTS

| | | |
|---|---|---|
| JP | 03-073637 U1 | 7/1991 |
| JP | 11-030136 A | 2/1999 |
| JP | 2001-115862 A | 4/2001 |

*Primary Examiner* — Syed O Hasan

(74) *Attorney, Agent, or Firm* — Panitch Schwarze Belissaro & Nadel LLP

(57) ABSTRACT

There is provided an engine stopping device including a stopping solenoid, where an operating shaft, interlocked to a control rack of a fuel injection pump, is rotatably supported by an engine case in a pass-through manner. The control rack is forcibly movable to a stopping position by an action of the stopping solenoid on an operation arm provided for a projecting portion of the operating shaft in an integrally rotatable manner. An extending-retracting rod of the stopping solenoid and the operation arm are interlocked by fitting engagement between a pin provided for the extending-retracting rod and a cut-out portion of the operation arm. The cut-out portion is configured in a shape elongated along a direction perpendicular to a movement trajectory of the extending-retracting rod.

7 Claims, 7 Drawing Sheets

(56) References Cited

U.S. PATENT DOCUMENTS 4,922,873 A * 5/1990 Gaeti ..... F02M 63/02
123/198 DB
5,131,358 A * 7/1992 Grieshaber ..... F02D 17/04
123/198 DB

* cited by examiner

ENGINE STOPPING DEVICE

BACKGROUND OF THE INVENTION

(1) Field of the Invention

The present invention relates to an engine stopping device.

(2) Description of Related Art

An engine provided for agricultural machines and industrial machines employs a governor for causing the engine to perform constant-speed rotation regardless of the magnitude of the load. Such a governor is provided with a starter spring for facilitating engine start-up by operating a control rack (metering tool) to a fuel-increasing side when the engine is started, and a stopping device for stopping the engine by operating the control rack to a fuel-decreasing side by a stopping operation.

A typical stopping device is configured such that an operating shaft interlockingly coupled to a governor lever is supported on an engine case in a pass-through manner, a part of the operating shaft protruding from the engine case is provided with an interlocking member such as an arm, and a stopping solenoid that is able to drive and operate the interlocking member is supported on the engine case.

Further, it is possible to employ a configuration in which the operation arm provided for the projecting part of the shaft is driven and operated by the stopping solenoid as one example of a linear actuator.

SUMMARY OF THE INVENTION

According to the conventional configuration, an extending-retracting rod as a linear output unit of the stopping solenoid and an operational lever that takes rotational motion are interlocked to transmit an operational force. In order to convert linear motion of the extending-retracting rod into the rotational motion of the operational lever, it is necessary to provide a configuration that can accommodate changing positions of coupled portions of the both components.

For example, when the extending-retracting rod and the operation arm are pivotably coupled, it is possible to employ a configuration in which the shaft and the hole are fitted with each other with sufficient play (so-called drilled hole configuration).

However, as the stopping solenoid with a constant stroke amount of extension and retraction of the extending-retracting rod is provided at a fixed position, there is a case in which due to a dimension error, an assembly error, or synergy of these, an operation becomes unstable such that the operation arm may not be operated to a stopping position, or may not be returned to a waiting position (a setting position of the governor).

An object of the present invention is to provide an engine stopping device that is improved such that while an operation arm that is pivotably supported is driven and operated by a stopping solenoid, the operation arm is driven and operated appropriately by the stopping solenoid even when there is a dimension error or an assembly error in components.

An engine stopping device according to the present invention includes:

a stopping solenoid, wherein an operating shaft interlocked to a control rack of a fuel injection pump is rotatably supported by an engine case in a pass-through manner, and the control rack is forcibly movable to a stopping position by an action of the stopping solenoid on an operation arm provided for a projecting portion of the operating shaft in an integrally rotatable manner, and an extending-retracting rod of the stopping solenoid and the operation arm are interlocked by fitting engagement between a pin provided for one of the extending-retracting rod and the operation arm with one of a hole and a cut-out portion provided for the other of the extending-retracting rod and the operation arm, the one of the hole and the cut-out portion is in a shape elongated along a direction intersecting a movement trajectory of the other of the extending-retracting rod and the operation arm.

According to the present invention, as the extending-retracting rod and the operation arm are interlocked by the fitting engagement between the pin and the hole or the cut-out portion elongated along the direction intersecting the movement trajectory, misalignment in movement directions between the extending-retracting rod that makes a linear motion and a hooking portion that makes a circular motion is absorbed by relative movement between the pin and the hole or the cut-out portion. Therefore, the operation arm may be driven and moved by the extending-retracting rod smoothly and stably.

As a result, as compared to a simple configuration such as a pin coupling configuration in which the extending-retracting rod and the operation arm are pivotably coupled in a simple manner, it is possible to eliminate possibility of a case in which due to a dimension error, an assembly error, or synergy of these, an operation becomes unstable such that the operation arm may not be moved to a stopping position, or may not be returned to a waiting position (a setting position of the governor).

DETAILED DESCRIPTION OF PREFERRED EMBODIMENTS

Figure 1A:
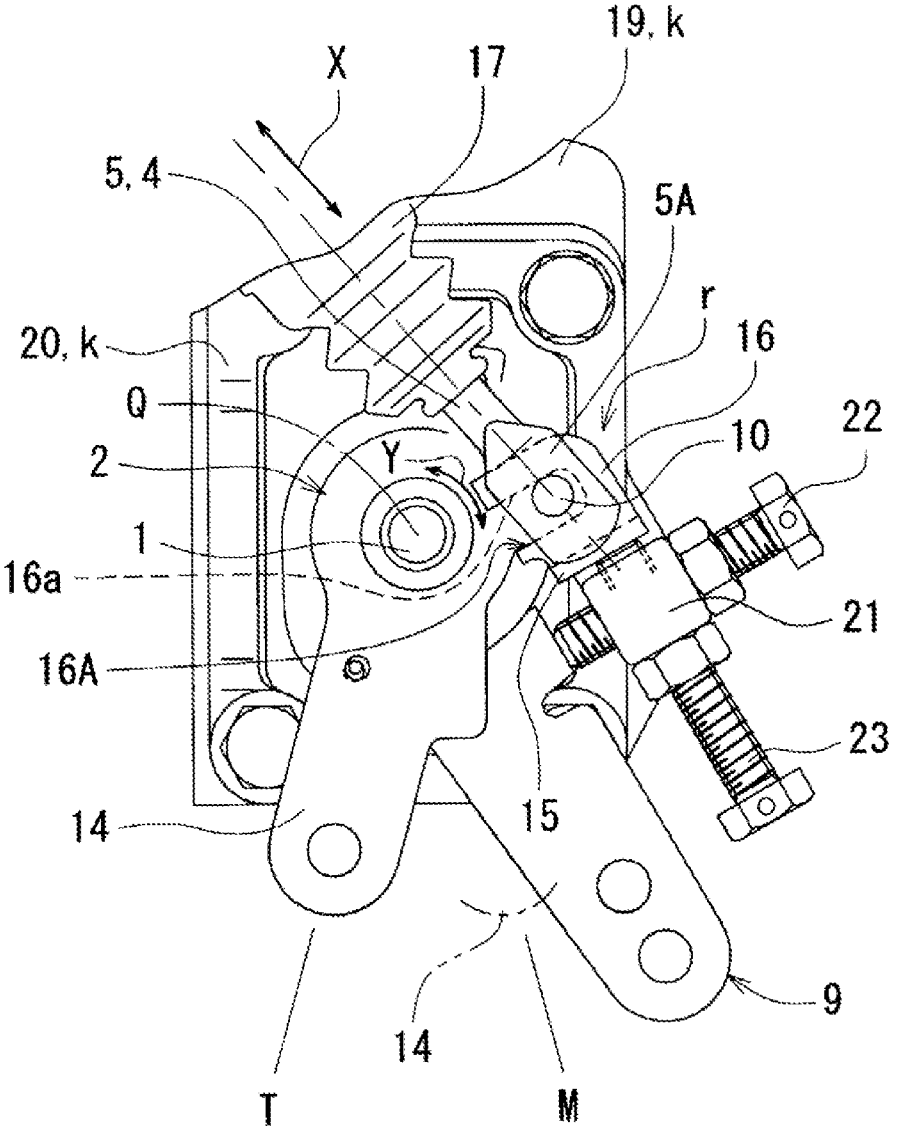
FIG. 1A is a partial plan view of a main portion showing relation between a stopping solenoid and an operating shaft.

Hereinafter, an embodiment of an engine stopping device according to the present invention will be described with reference to the drawings, taking an example in which the device is employed in an industrial diesel engine provided for a tractor and the like. Here, an engine case k is an idea including a cylinder block 40, a gear case 18, a pump containing case 27, an operating shaft supporting plate 20, and a cylinder head 42.

Figure 3:
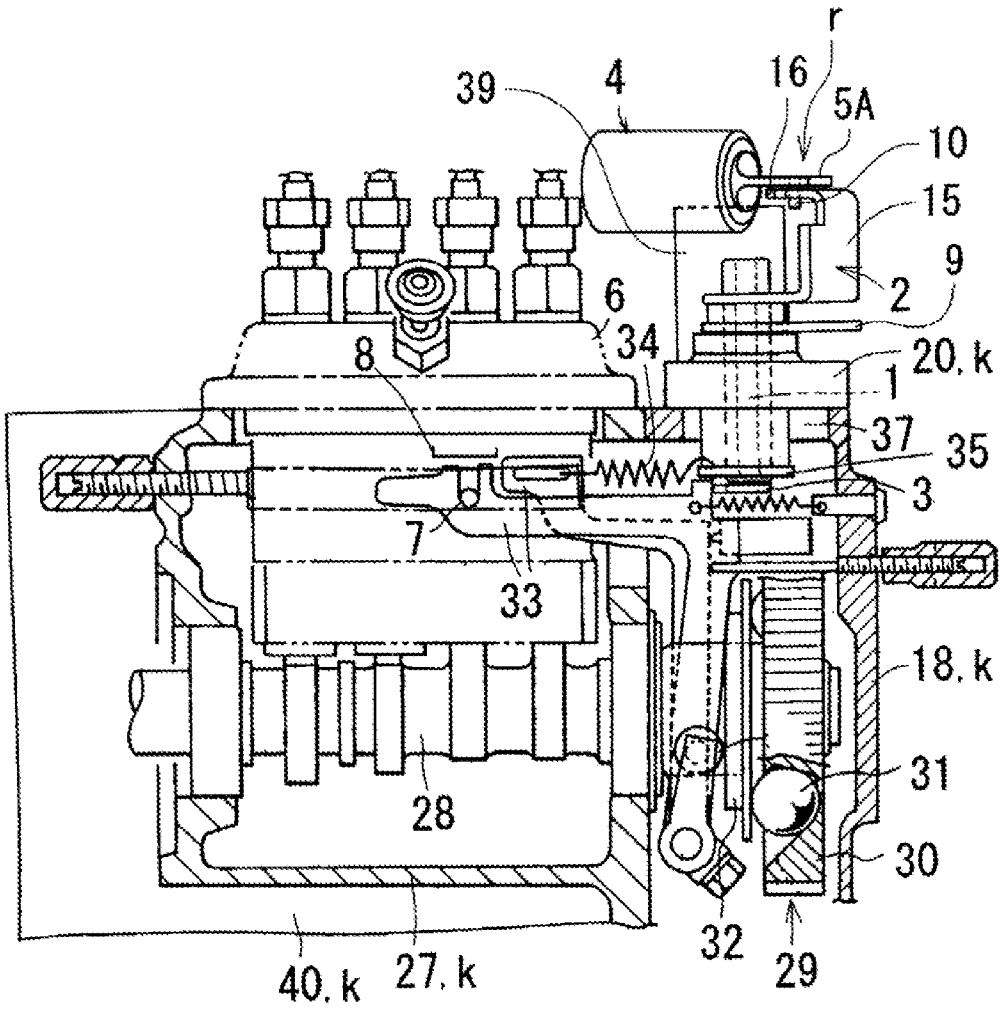
FIG. 3 is a vertical cross-sectional side view around a fuel injection pump showing the engine stopping device.

As shown in FIGS. 1A and 3, the pump containing case 27 is integrally provided adjacent to the cylinder block 40, and the gear case 18 is assembled in front of the cylinder block 40. A fuel injection pump 6 is inserted into the pump containing case 27 from its top, and a fuel camshaft (fuel injection camshaft) 28 is contained in the lower part of the pump containing case 27. Within the gear case 18, a timing gear train 29 is contained.

A governor weight 31 is positioned at a fuel injection cam gear 30 as a component of the timing gear train 29, the governor weight 31 is brought into contact with a governor sleeve 32, and the governor sleeve 32 is brought into contact with a governor lever 33. The governor lever 33 is interlockingly coupled to a speed governing lever 35 via a governor spring 34. To the governor lever 33, a fuel metering unit 7 of the fuel injection pump 6 is interlockingly coupled. The fuel metering unit 7 is a part (rack pin) of a fuel metering rack (control rack).

Figure 1B:
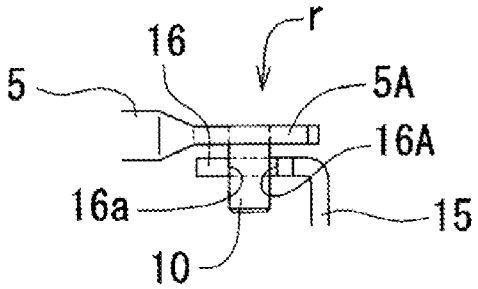
FIG. 1B is a side view of a main portion showing an interlocking structure between an extending-retracting rod and a hooking portion.
Figure 2:
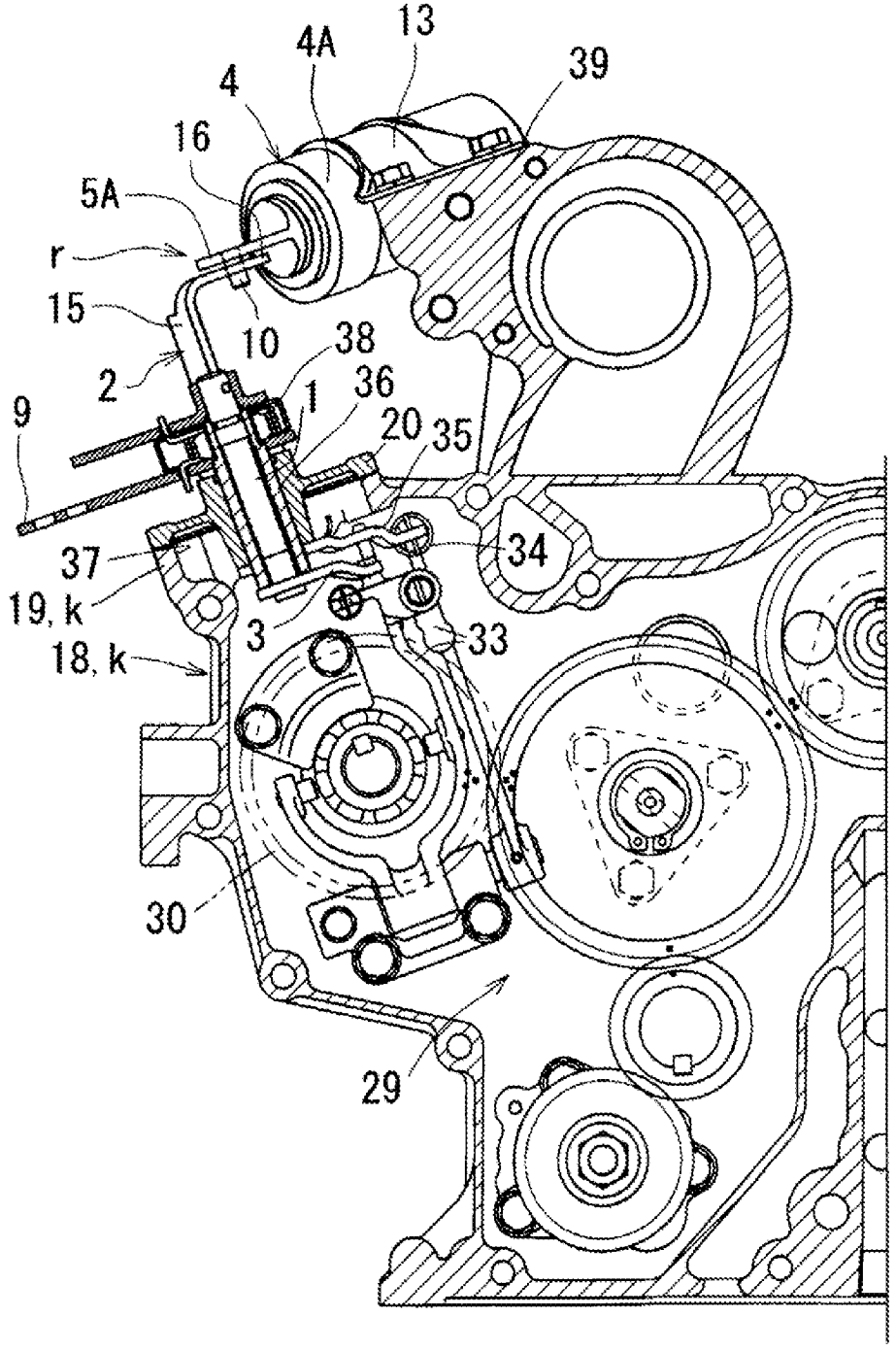
FIG. 2 is a vertical cross-sectional front view of a gear case showing an engine stopping device.

The engine stopping device will be described. As shown in FIGS. 1A, 1B, and 2, an operation arm 2 as an input lever and an output lever 3 are attached to an operating shaft 1, and an input lever unit 16 of the operation arm 2 and an extending-retracting rod (also referred to as an actuator output unit, a shaft, or a spindle) 5 of a stopping solenoid 4 as a linear output unit are interlocked by an interlocking coupling mechanism r.

Therefore, it is possible to forcibly move a control rack 7 to a stopping position by acting the stopping solenoid 4 on the operation arm 2. It is configured such that linear motion of the extending-retracting rod 5 is transmitted to the fuel metering unit 7 of the fuel injection pump 6 via rotational motion of the operation arm 2, the operating shaft 1, and the output lever 3, and the fuel metering unit 7 is moved to a non-fuel-injection position (stopping position) 8.

As shown in FIGS. 1A, 1B, and FIG. 2, the operating shaft 1 is rotatably and internally fitted within a cylindrical speed governing lever shaft 36, and the speed governing lever shaft 36 is rotatably supported by the operating shaft supporting plate 20. The operating shaft supporting plate 20 is fixed by a bolt so as to serve as a cover for an opening 37 in a peripheral wall 19 of the gear case 18. The speed governing lever 35 is attached to the speed governing lever shaft 36 at a portion within the gear case 18, and a speed regulator lever 9 is attached to the speed governing lever shaft 36 at a portion outside the gear case 18.

The operation arm 2 is attached to the operating shaft 1 at a portion outside the gear case 18, and the output lever 3 is attached to the operating shaft 1 at a portion within the gear case 18. The stopping solenoid 4 is supported on the gear case 18 by fixing a sheet metal bracket 13 fixed to a housing unit 4A to an attachment seat 39 of the gear case 18 by a bolt. The sheet metal bracket 13 is provided with a circular arc portion 13A covering a housing main body 4*a*, folding edges 13*a* and 13*a* on both ends, two bolt holes 13*b* and 13*b*.

The extending-retracting rod 5 of the stopping solenoid 4 is moved retracting in a direction in which an amount of projection from the housing unit 4A decreases (tensioning direction) when it is energized, and is resumed and maintained at a position projected from the housing unit 4A by a predetermined amount when it is not energized. The operation arm 2 is urged at an interlocking waiting position (a position at which a main body lever 14 is at a waiting position T) by a retractor spring 38. Therefore, when the stopping solenoid 4 is not energized, the operation arm 2 (including the operating shaft 1 and the output lever 3) receives an elastic urging force of the retractor spring 38, and the extending-retracting rod 5 is resumed and maintained at the interlocking waiting position.

By operating a key switch (not shown) to an engine stopping position, the stopping solenoid 4 is energized for a predetermined period by a timer, and the extending-retracting rod 5 is operated to the tensioning direction. With this, the operation arm 2, the operating shaft 1, and the output lever 3 are rotated against the urging force of the retractor spring 38, and the fuel metering unit 7 of the fuel injection pump 6 is moved to the non-fuel-injection position 8 via swinging movement of the governor lever 33.

Figure 5:
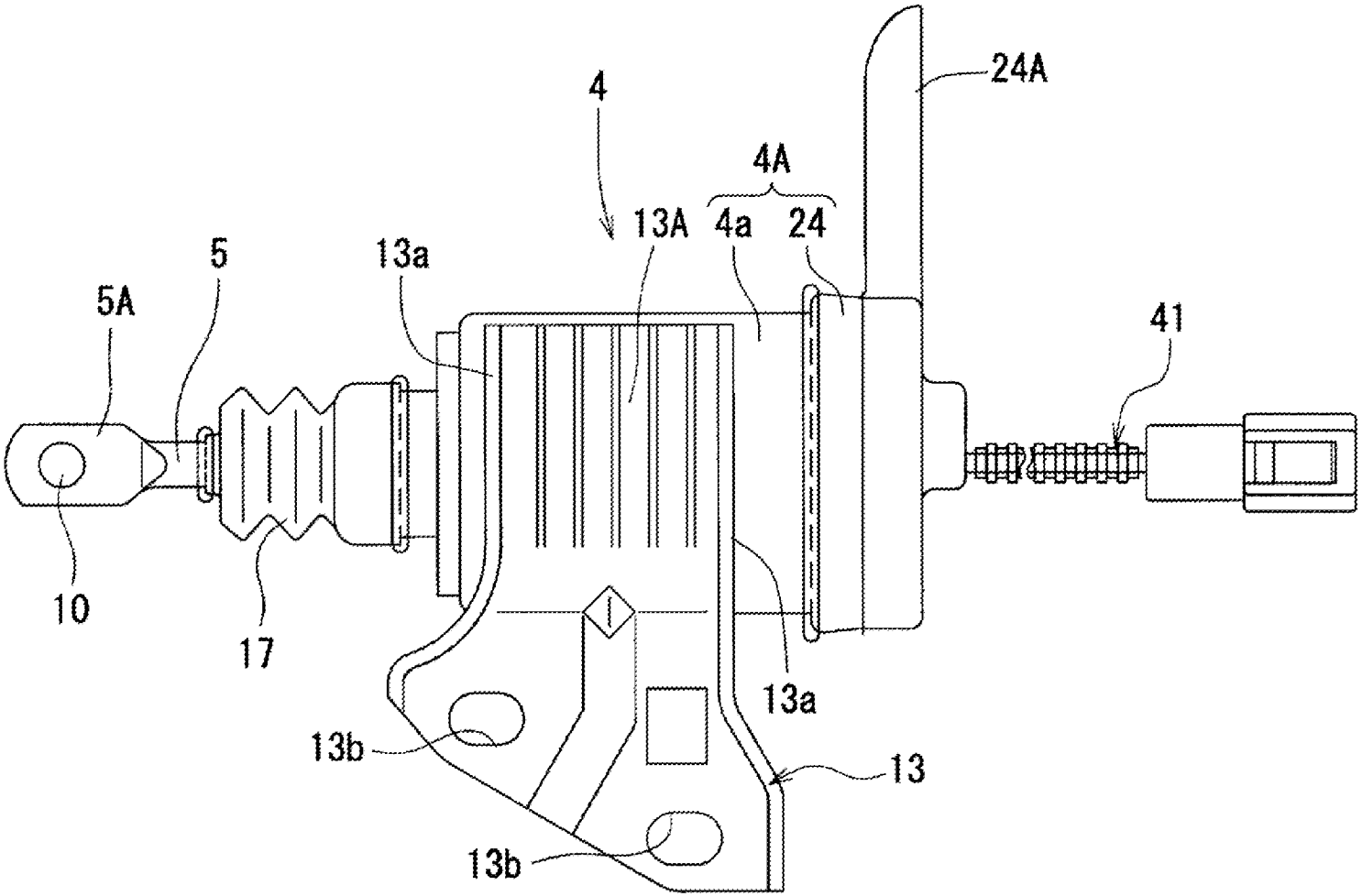
FIG. 5 is a plan view of the stopping solenoid used in the engine stopping device.
Figure 6:
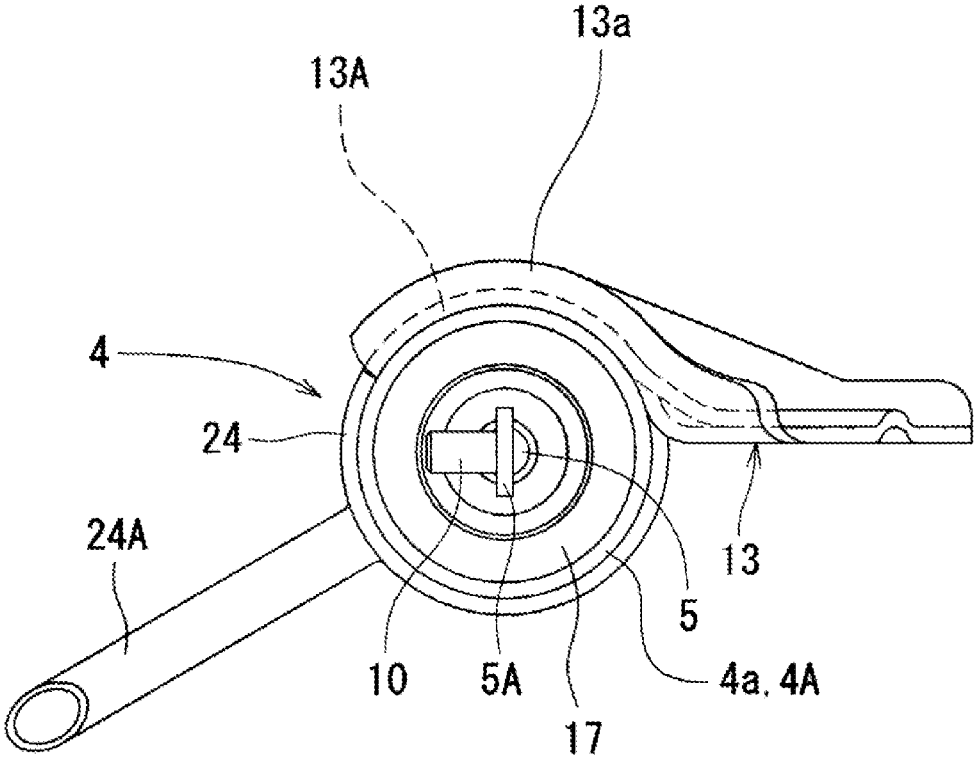
FIG. 6 is a front view of the stopping solenoid in FIG. 5.

The interlocking coupling mechanism r between the extending-retracting rod 5 and the operation arm 2, and the stopping solenoid 4 will be described. As shown in FIGS. 3, 5, and 6, the stopping solenoid 4 includes the housing unit 4A and the extending-retracting rod 5. The extending-retracting rod 5 is extended and retracted by sliding motion (linear motion) against the housing unit 4A. The extending-retracting rod 5 is maintained at a waiting position that is projected to a maximum extent when it is not energized, and is driven and maintained at an acting position that is retracted to a maximum extent with respect to the housing unit 4A when it is energized by being moved to retract from the waiting position.

A tip end portion 5A of the extending-retracting rod 5 that is made of a rod-shaped metallic material is a flat-plated portion that is crushed and flattened, and a pin 10 stands on a surface of the flat-plated tip end portion 5A. The pin 10 is made of column-shaped metallic material, and integrated with the tip end portion 5A by swaging, press fitting, or welding.

As shown in FIGS. 1A and 1B, the operation arm 2 includes the main body lever 14 attached to the operating shaft 1, an upright lever unit 15 that stands from a base of the main body lever 14 along a longitudinal direction of the shaft of the operating shaft 1, and an input lever unit 16 formed by bending a tip end of the upright lever unit 15. The upright lever unit 15 is bent by 90 degrees with respect to the main body lever 14, and the input lever unit 16 is bent by 90 degrees with respect to the upright lever unit 15, and the main body lever 14 and the input lever unit 16 are parallel to each other.

As shown in FIGS. 1A and 1B, the input lever unit 16 of the operation arm 2 is formed in a U shape having a cut-out portion 16A opening toward a shaft center Q of the operating shaft 1. In other words, the cut-out portion 16A is a cut-out provided depressing in a direction perpendicular to a movement trajectory (an arrow Y) of the operation arm 2. An acting side 16*a* which is a long side and one of two opposing sides of the cut-out portion 16A that is on a side opposing to the upright lever unit 15 (on a side of the stopping solenoid 4) also serves as a sliding surface that is brought into contact with the pin 10 of the tip end portion 5A of the extending-retracting rod 5. The acting side 16*a* is a plane by a thickness of the operation arm 2 (acting plane). Further, an inner width of the cut-out portion 16A is slightly larger than a diameter of the pin 10.

The extending-retracting rod 5 and the operation arm 2 are interlocked by the pin 10 fitting into the cut-out portion 16A with a slight gap between the tip end portion 5A and the input lever unit 16. In this manner, the extending-retracting rod 5 and the operation arm 2 are interlocked by the interlocking coupling mechanism r which is engagement between the pin 10 and the cut-out portion 16A.

In FIG. 1A, a square block 21 that stands is provided integrally with the operating shaft supporting plate 20, and a first stopper bolt 22 is screwed into a lower portion of the square block 21, and a second stopper bolt 23 is screwed into an upper portion of the square block 21. The first stopper bolt 22 is configured such that its tip end is brought into contact with an end of the speed regulator lever 9 to define its returning position. The second stopper bolt 23 is configured such that its tip end is brought into contact with the upright lever unit 15 to define a resuming position of the operation arm 2.

FIG. 1A shows a non-energized state in which the stopping solenoid 4 is not energized, and the operation arm 2 is not operated, and an interlocking waiting state in which the main body lever 14 is urged and maintained at the waiting position T by the retractor spring 38. At this time, the upright lever unit 15 is brought into contact with the tip end of the second stopper bolt 23, and the extending-retracting rod 5 is urged and maintained at a projecting position by the interlocking coupling mechanism r.

When the stopping solenoid 4 is energized, the extending-retracting rod 5 is moved and retracted and the input lever unit 16 is tensioned by the pin 10 that is brought into contact with the acting side 16*a*, the operating shaft 1 rotates leftward in FIGS. 1A and 1B, and the main body lever 14 swings and moves from the waiting position T to a non-injecting position M (the engine is stopped).

As shown in FIG. 1A, while the extending-retracting rod 5 linearly moves in a direction of an arrow X which is its longitudinal direction, the input lever unit 16 circularly moves in a direction of an arrow Y about the shaft center Q of the operating shaft 1. Accordingly, their movement trajectories do not meet. Therefore, the extending-retracting rod 5 and the input lever unit 16 (the operation arm 2) may not be simply pivotably coupled, and may be pivotably coupled using a drilled hole, and the latter is employed in the conventional technique.

However, in practice, there are cases in which their movement trajectories are displaced to each other in side view in addition to error absorption in planar view due to difference in the movement trajectories, and accordingly their movement trajectories are often displaced three-dimensionally.

Therefore, it is extremely difficult to accommodate three-dimensional displacement described above by the configuration in which the extending-retracting rod 5 and the operation arm 2 are simply pivotably coupled by a drilled hole.

According to the engine stopping device of the present invention, the pin 10 and the cut-out portion 16A are engaged, and a long side extending linearly along the direction intersecting (perpendicular to) the moving direction of the extending-retracting rod 5 is taken as the acting side 16*a* of the cut-out portion 16A. Therefore, as compared to the conventional configuration in which a pin is brought into contact with a circular arc edge by the drilled hole, the pin 10 slides and moves along the acting side 16*a* more smoothly, and the function of the interlocking coupling mechanism r becomes smoother. In addition, as the tip end portion 5A and the input lever unit 16 are spaced apart in the longitudinal direction of the pin 10 (up and down direction), even if the movement trajectory of the extending-retracting rod 5 and the movement trajectory of the input lever unit 16 are displaced or inclined to each other in side view, the input lever unit 16 may be smoothly tensioned and operated by the extending-retracting rod 5.

Specifically, the extending-retracting rod 5 of the stopping solenoid 4 and the input lever unit 16 of the operation arm 2 are interlockingly coupled by the interlocking coupling mechanism r that is three-dimensionally flexible. Therefore, even if the movement trajectory of the extending-retracting rod 5 and the movement trajectory of the input lever unit 16 (the operation arm 2) are displaced with each other in any direction of front, back, right, and left, it is possible to smoothly operate the operation arm 2 by the stopping solenoid 4 to achieve both a complete stop state in which the engine is completely stopped and a complete free state in which the extending-retracting rod 5 does not interfere the operation arm 2.

As described above, there is an advantage that while the stopping solenoid 4 drives and operates the operation arm 2 pivotably supported, it is possible to appropriately drive and operate the operation arm 2 using the stopping solenoid 4 even when there are a dimension error and an assembly error of the components, and to assemble the components regardless of skill. Further, cumbersome work requiring positional adjustment assembly of the housing unit 4A by the bolt holes 13*b* and 13*b* is eliminated or reduced, and thus it is possible to provide the engine stopping device with which the stopping solenoid 4 works in good conditions by simple assembly work at low costs.

The engine stopping device according to the present invention is configured such that the operation arm 2 is elastically urged in the direction in which the amount of injection by the fuel injection pump 6 per unit time increases, and the stopping solenoid 4 forcibly moves the operation arm 2 in the decreasing direction opposite of the increasing direction. The second stopper bolt 23 works as a stopper that restrains movement of the operation arm 2 in the increasing direction.

Supplemental remarks for the stopping solenoid 4 shall be made.

As shown in FIGS. 5 and 6, the housing unit 4A includes the housing main body 4*a* made of high-strength material and a cap 24 made of a flexible material and covered over the housing main body 4*a*. At the base end of the housing main body 4*a* made of a steel plate or the like, the rubber cap 24 is attached, and a lead wire 41 is fed out from the cap 24. A tubular member radially extending from the cap 24 is a drain hole tube 24A for preventing formation of dew condensation water. A reference 17 indicates a rubber bellows boot that covers the extending-retracting rod 5 from the base.

An example how the stopping solenoid 4 is attached to an engine E will be briefly described.

Figure 4:
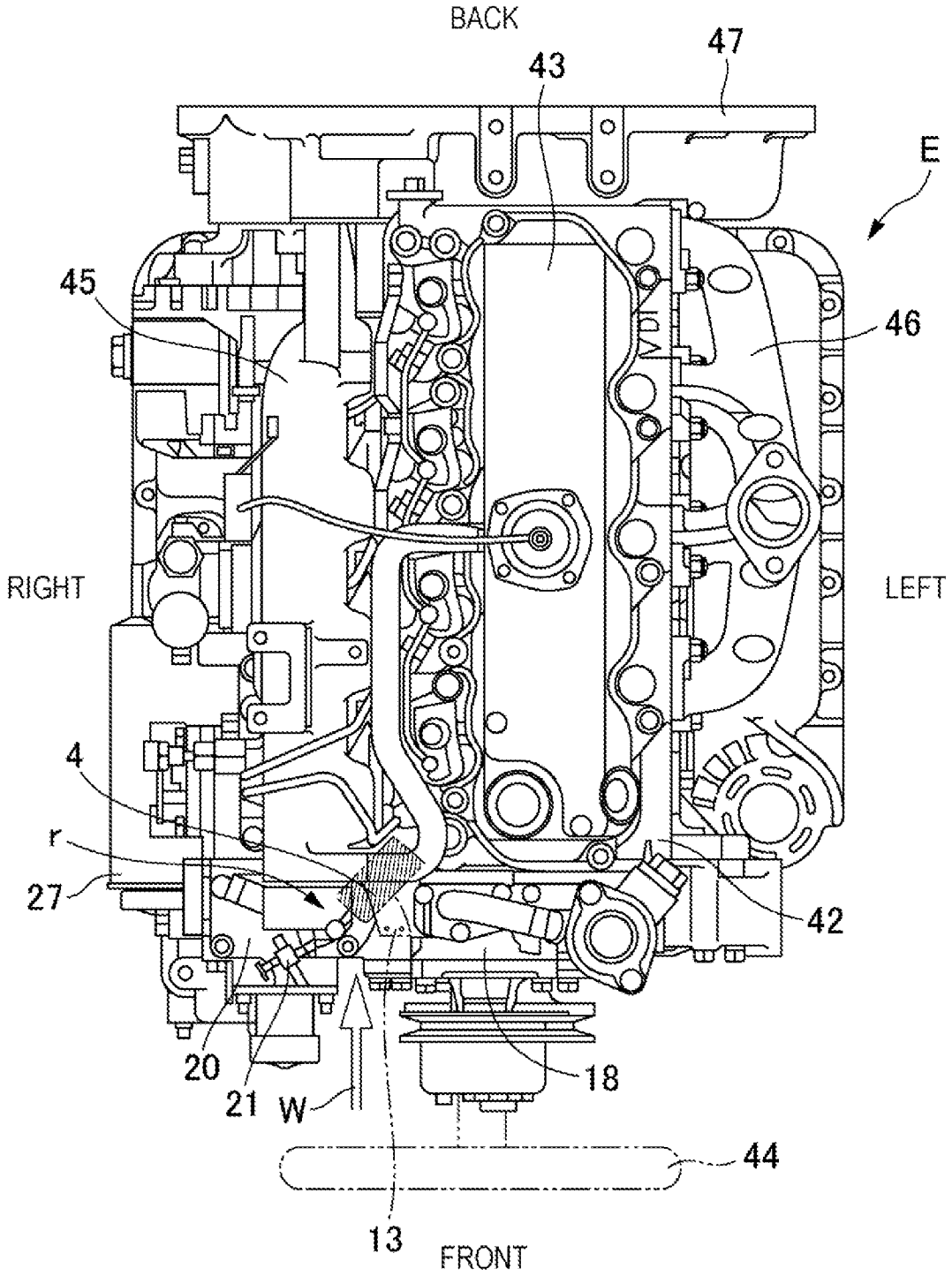
FIG. 4 is a plan view of an engine showing a portion for attaching the stopping solenoid.

As shown in FIG. 4, the industrial diesel engine E includes the cylinder head 42, a head cover 43, an engine cooling fan 44, an intake manifold 45, an exhaust manifold 46, a flywheel housing 47, and the like. The stopping solenoid 4 attached at an upper side of the gear case 18 is disposed at an upper portion of an engine front portion, where cooling wind W from the engine cooling fan 44 easily blows. Therefore, there is an advantage that even if the temperature of the engine E or an engine room (not shown) increases, the stopping solenoid 4 (and the bracket 13) may be efficiently cooled and its temperature may not rise easily.

In the meantime, conventionally, there is a case in which when assembling the stopping solenoid and the like, an operation of fixing by bolt while finely adjusting looseness of the operation arm and the stopping solenoid so that appropriate operation is possible is performed. However, such an operation requires skill, and is not an operation that can be carried out by anyone. Therefore, this is not sufficient to eliminate the possibility that "an operation becomes unstable" described previously.

According to the present invention, it is possible to provide an engine stopping device that is improved such that while the operation arm that is pivotably supported is driven and moved by the stopping solenoid, the operation arm is driven and moved appropriately by the stopping solenoid even when there is a dimension error or an assembly error in components, and assembly of the components may be carried out regardless of skill.

Different Example

Figure 7:
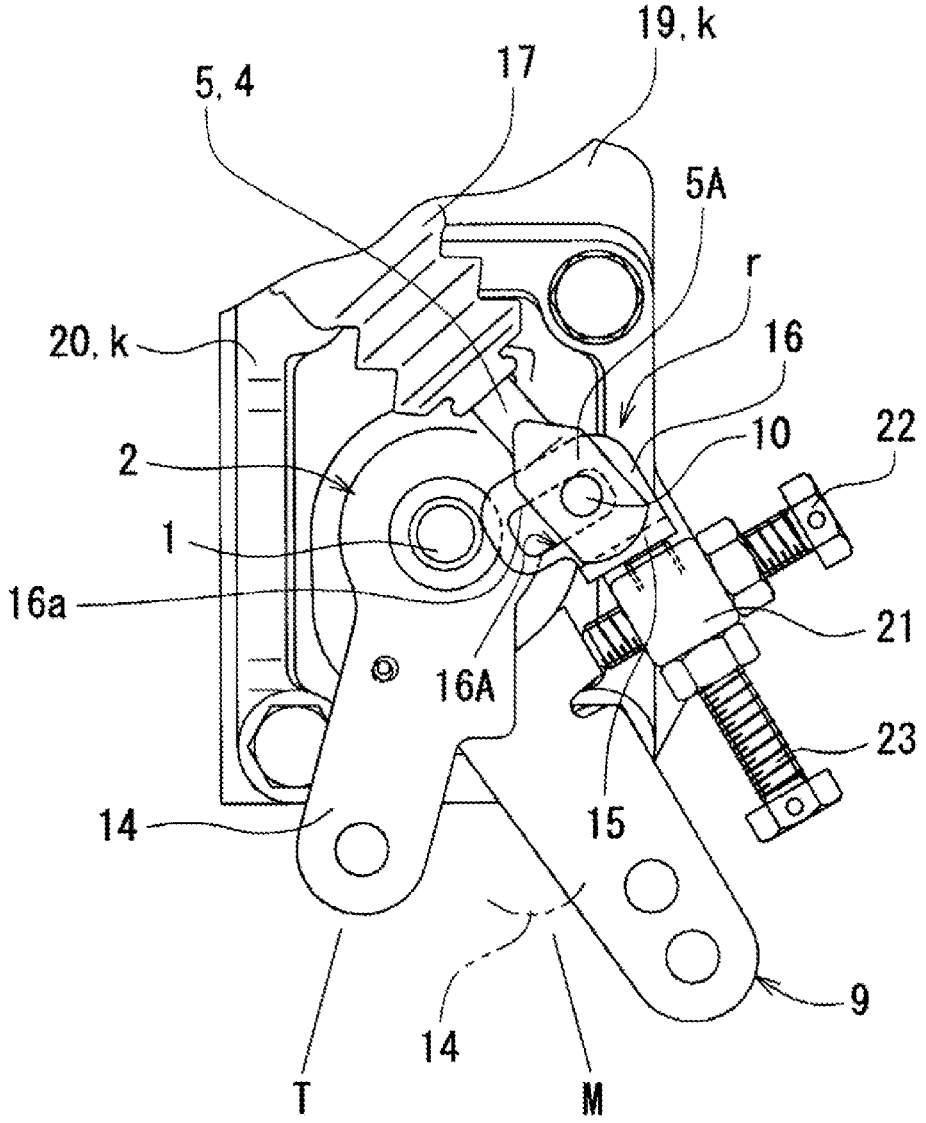
FIG. 7 is a plan view of a main portion showing another configuration of an input lever unit.

As shown in FIG. 7, as the portion of the input lever unit 16 in which the pin 10 is inserted, a hole 16A elongated in a radial direction of the shaft center Q of the operating shaft 1 (distance direction) may be employed.

Comparing the configuration of using the elongated hole 16A and the configuration of using the cut-out portion 16A (see FIGS. 1A and 1B and others), when the operating shaft 1 and the input lever unit 16 interfere each other, the cut-out portion 16A may be located closer to the shaft center Q than the elongated hole 16A, assuming that amounts of movement in a radial direction of the shaft center Q of the input lever unit 16 of the pin 10 are the same.

What is claimed is:

1. An engine stopping device, wherein an operating shaft interlockingly coupled to a control rack of a fuel injection pump is rotatably supported by an engine case, and the control rack is forcibly movable to a stopping position by an action of a stopping solenoid on an operation arm provided for a projecting portion of the operating shaft in an integrally rotatable manner, the operation arm includes a main body lever attached to the operating shaft, an upright lever unit that stands from a base of the main body lever along a longitudinal direction of a shaft of the operating shaft, and an input lever unit formed by bending a tip end of the upright lever unit, and an extending-retracting rod of the stopping solenoid and the input lever unit of the operation arm are interlocked by fitting engagement between a pin provided for one of the extending-retracting rod and the operation arm with one of a hole and a cut-out portion provided for the other of the extending-retracting rod and the operation arm, the extending-retracting rod moving linearly and the input lever unit moving circularly, the one of the hole and the cut-out portion is in a shape elongated along a direction intersecting a movement trajectory of the other of the extending-retracting rod and the operation arm.

2. The engine stopping device according to claim 1, wherein the one of the hole and the cut-out portion is defined in the operation arm.

3. The engine stopping device according to claim 2, wherein the one of the hole and the cut-out portion is a cut-out defined along a direction perpendicular to the movement trajectory of the operation arm.

4. The engine stopping device according to claim 3, wherein the cut-out portion is provided in shape opening toward a shaft center of the operating shaft.

5. The engine stopping device according to claim 2, wherein the pin is provided on a tip end of the extending-retracting rod.

6. The engine stopping device according to claim 3, wherein the pin is provided on a tip end of the extending-retracting rod.

7. The engine stopping device according to claim 4, wherein the pin is provided on a tip end of the extending-retracting rod.

* * * * *